US005435036A

United States Patent [19]

Hedrick et al.

[11] Patent Number: 5,435,036

[45] Date of Patent: Jul. 25, 1995

[54] APPARATUS FOR WASHING A PLURALITY OF BABY BOTTLES AND ASSOCIATED COMPONENTS CONCURRENTLY

[76] Inventors: Bryan E. Hedrick, 2752 Lakeside Dr., Lexington, Ohio 44904; Donald D. Hedrick, 297 Fairlawn Ave., Mansfield, Ohio 44903

[21] Appl. No.: 285,157

[22] Filed: Aug. 3, 1994

[51] Int. Cl.[6] ..... A46B 13/04; A47L 15/37

[52] U.S. Cl. ..... 15/59; 15/88.3; 15/88.4

[58] Field of Search ..... 15/56, 59, 65, 66, 67, 15/69, 70, 71, 88.2, 88.3

[56] References Cited

U.S. PATENT DOCUMENTS

| | | | |
|---|---|---|---|
| 1,446,553 | 2/1923 | Eberly | 15/59 |
| 2,340,215 | 1/1944 | Fowler | 15/59 |
| 2,430,132 | 11/1947 | Luker | 15/71 |
| 4,115,891 | 9/1978 | Wills | 15/71 |

*Primary Examiner*—Edward L. Roberts, Jr.

[57] ABSTRACT

An apparatus for washing a plurality of baby bottles and associated components concurrently comprising a housing having front and rear walls, side walls, a lower base coupling together the walls in a box-like configuration and an upper plate with a plurality of aligned apertures extending therethrough; a drive shaft mounted for rotation adjacent to the lower surface of the housing parallel with the base, the main drive shaft having a plurality of driving bevel gears spaced along its length; a plurality of driven shafts with driven bevel gears in operative association with the driving bevel gears of the main drive shaft, each driven bevel gear having in association therewith three parallel rods with mating gears interrelated with its associated driven bevel gear to effect rotation of the mating gears and parallel rods from the driven bevel gears; brush bristles formed at the upper ends of the parallel rods in proximity to the apertures of the upper plate the first set of parallel rods having short cone-shaped bristles to clean a nipple, the second and third set of parallel rods having short cylindrical bristles to clean a lid and a cap, the fourth set of parallel rods having long cylindrical bristles to clean a bottle, inside and outside; a motor within the housing geared to the main drive shaft; and a lid positionable over the upper plate of the housing adjacent to the apertures to seal the interior of the housing.

3 Claims, 5 Drawing Sheets

APPARATUS FOR WASHING A PLURALITY OF BABY BOTTLES AND ASSOCIATED COMPONENTS CONCURRENTLY

BACKGROUND OF THE INVENTION

1. Field of the Invention

The present invention relates to an apparatus for washing a plurality of baby bottles and associated components concurrently and more particularly pertains to washing baby bottles as well as associated nipples, lids and caps automatically and simultaneously with a simple one-piece device.

2. Description of the Prior Art

The use of devices of various designs and constructions for washing baby bottles and other objects is known in the prior art. More specifically, devices of various designs and constructions for washing baby bottles and other objects heretofore devised and utilized for the purpose of cleaning baby bottles with devices of various designs and constructions as well as cleaning associated components such as nipples, lids, caps and the like are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,956,791 a bottle washing machine.

U.S. Pat. No. 4,089,080 discloses a machine for treating hollow bowl-shaped objects.

U.S. Pat. No. 4,145,954 discloses a container cleaning apparatus.

U.S. Pat. No. 4,149,292 discloses an automatic machine for washing open containers.

U.S. Pat. No. 4,502,176 discloses a bottle brush/glass cleaner.

In this respect, the apparatus for washing a plurality of baby bottles and associated components concurrently according to the present invention substantially departs from the conventional concepts and designs of the prior art, and in doing so provides an apparatus primarily developed for the purpose of washing baby bottles as well as associated nipples, lids and caps automatically and simultaneously with a simple one-piece device.

Therefore, it can be appreciated that there exists a continuing need for a new and improved apparatus for washing a plurality of baby bottles and associated components concurrently which can be used for washing baby bottles as well as associated nipples, lids and caps automatically and simultaneously with a simple one-piece device. In this regard, the present invention substantially fulfills this need.

SUMMARY OF THE INVENTION

In view of the foregoing disadvantages inherent in the known types of devices of various designs and constructions for washing baby bottles and other objects now present in the prior art, the present invention provides an improved apparatus for washing a plurality of baby bottles and associated components concurrently. As such, the general purpose of the present invention, which will be described subsequently in greater detail, is to provide a new and improved apparatus for washing a plurality of baby bottles and associated components concurrently and method which has all the advantages of the prior art and none of the disadvantages.

To attain this, the present invention essentially comprises a new and improved apparatus for washing a plurality of baby bottles and associated components concurrently comprising, in combination, a housing having large rectangular front and rear walls, small rectangular side walls, a lower base coupling together the walls in a box-like configuration and an upper plate with a plurality of aligned apertures extending therethrough; a main drive shaft mounted for rotation adjacent to the lower surface of the housing parallel with the base, the main drive shaft having a plurality of driving bevel gears spaced along its length; a plurality of driven shafts with driven bevel gears in operative association with the driving bevel gears of the main drive shaft, each driven bevel gear having in association therewith three parallel rods with mating gears interrelated with its associated driven bevel gear to effect rotation of the mating gears and parallel rods from the driven bevel gears; brush bristles formed at the upper ends of the parallel rods in proximity to the apertures of the upper plate the first set of parallel rods having short cone-shaped bristles to clean a nipple, the second and third set of parallel rods having short cylindrical bristles to clean a lid and a cap, the fourth set of parallel rods having long cylindrical bristles to clean a bottle, inside and outside; a motor within the housing geared to the main drive shaft to effect the activation and inactivation of the drive shaft and associated gears and parallel shafts whereby when a baby bottle, cap and nipple are positioned through the apertures onto the bristles, they will be cleaned inside and outside when the motor is activated; a lid positionable over the upper plate of the housing adjacent to the apertures to seal the interior of the housing during operation and use with hinges along adjacent edges of the housing and lid to effect the opening and closing thereof; and an actuation button secured to the housing adjacent to the lid whereby when the lid is closed the button will be depressed to activate the motor to effect the cleaning of objects within the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatus for washing a plurality of baby bottles and associated components concurrently which have all the advantages of the prior art devices of various designs and constructions for washing baby bottles and other objects and none of the disadvantages.

It is another object of the present invention to provide new and improved apparatus for washing a plurality of baby bottles and associated components concurrently which may be easily and efficiently manufactured and marketed.

It is a further object of the present invention to provide a new and improved apparatus for washing a plurality of baby bottles and associated components concurrently which are of durable and reliable constructions.

An even further object of the present invention is to provide a new and improved apparatus for washing a plurality of baby bottles and associated components concurrently which is susceptible of a low cost of manufacture with regard to both materials and labor, and which accordingly is then susceptible of low prices of sale to the consuming public, thereby making such apparatus for washing a plurality of baby bottles and associated components concurrently economically available to the buying public.

Still yet another object of the present invention is to provide a new and improved apparatus for washing a plurality of baby bottles and associated components concurrently which provides in the apparatuses and methods of the prior art some of the advantages thereof, while simultaneously overcoming some of the disadvantages normally associated therewith.

Still another object of the present invention is to wash baby bottles as well as associated nipples, lids and caps automatically and simultaneously with a simple one-piece device.

Lastly, it is an object of the present invention to provide a new and improved apparatus for washing a plurality of baby bottles and associated components concurrently comprising a housing having large rectangular front and rear walls, small rectangular side walls, a lower base coupling together the walls in a box-like configuration and an upper plate with a plurality of aligned apertures extending therethrough; a main drive shaft mounted for rotation adjacent to the lower surface of the housing parallel with the base, the main drive shaft having a plurality of driving bevel gears spaced along its length; a plurality of driven shafts with driven bevel gears in operative association with the driving bevel gears of the main drive shaft, each driven bevel gear having in association therewith three parallel rods with mating gears interrelated with its associated driven bevel gear to effect rotation of the mating gears and parallel rods from the driven bevel gears; brush bristles formed at the upper ends of the parallel rods in proximity to the apertures of the upper plate the first set of parallel rods having short cone-shaped bristles to clean a nipple, the second and third set of parallel rods having short cylindrical bristles to clean a lid and a cap, the fourth set of parallel rods having long cylindrical bristles to clean a bottle, inside and outside; a motor within the housing geared to the main drive shaft to effect the activation and inactivation of the drive shaft and associated gears and parallel shafts whereby when a baby bottle, cap and nipple are positioned through the apertures onto the bristles, they will be cleaned inside and outside when the motor is activated; and a lid positionable over the upper plate of the housing adjacent to the apertures to seal the interior of the housing during operation and use with hinges along adjacent edges of the housing and lid to effect the opening and closing thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
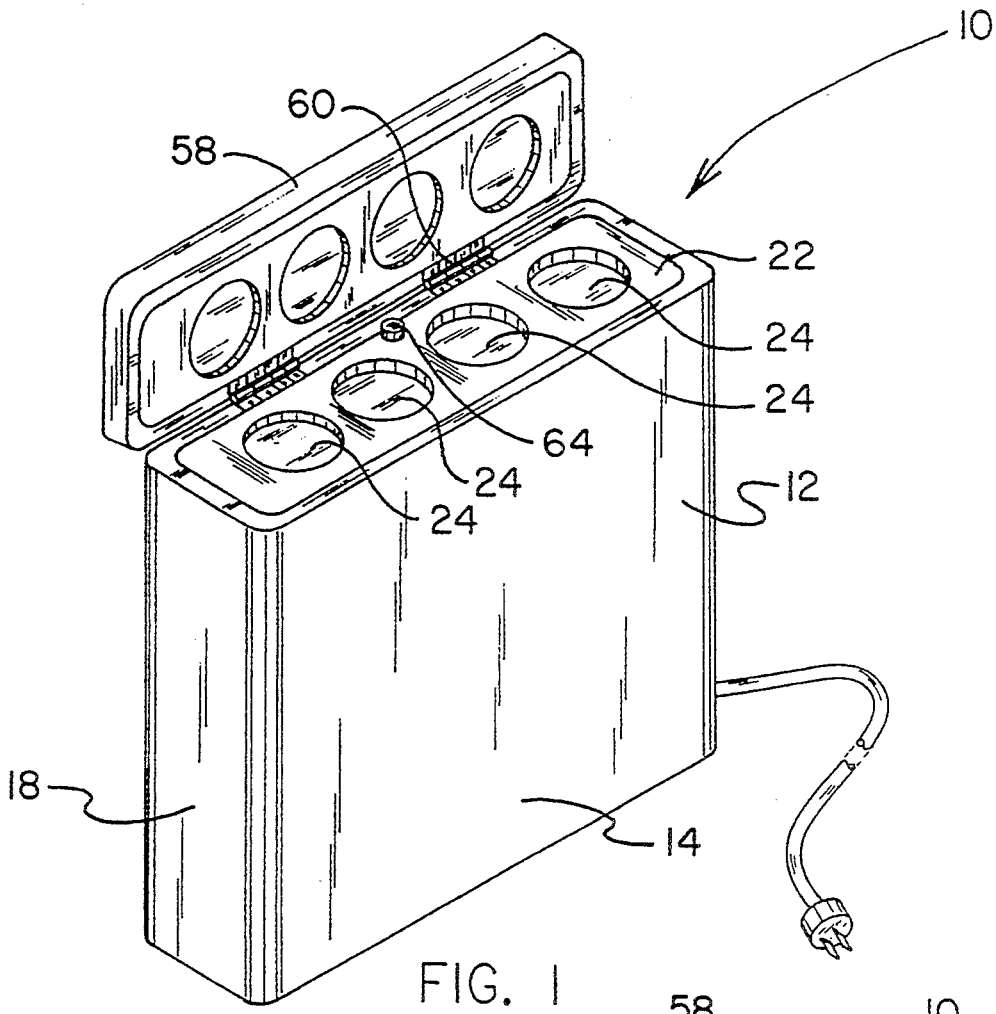
FIG. 1 is a perspective view of the preferred embodiment of the apparatus for washing a plurality of baby bottles and associated components concurrently constructed in accordance with the principles of the present invention.

With reference now to the drawings, and in particular to FIG. 1 thereof, the preferred embodiment of the new and improved apparatus for washing a plurality of baby bottles and associated components concurrently embodying the principles and concepts of the present invention and generally designated by the reference numeral 10 will be described.

The present invention, the new and improved apparatus for washing a plurality of baby bottles and associated components, is a system comprised of a plurality of components. Such components are individually configured and correlated with respect to each other so as to attain the desired objective.

The present invention is a system 10 which has a housing 12 as its main component. The housing is formed with a large rectangular front wall 14 and rear wall 16 parallel to each other. The housing also includes small rectangular side walls 18. A lower base 20 couples together the walls in a box-like configuration. In addition, an upper plate 22 is provided at the upper edge of the walls. The upper plate has a plurality of aligned apertures 24 extending therethrough. In the preferred embodiment for such apertures are utilized.

Within the housing at the lower extent thereof is a main drive shaft 28. Such shaft is mounted for rotation adjacent to the lower surface of the housing parallel with the base. The main drive shaft has a plurality of driving bevel gears 30 spaced along its base.

In association with the main drive shaft and in proximity therewith are a plurality of driven shafts 34. Each driven shaft has a drive bevel gear 36. Each such driven bevel gear is in operative bevel gears of the main drive shaft. Each driven bevel gear has an association therewith a plurality of parallel rods 38, three in the preferred embodiment with mating gears 40 interrelated with an associated driven bevel gear. This is to effect rotation and counter-rotation of the mating gears and parallel rods from the driven bevel gear.

Each of the parallel rods has brush bristles formed at the upper ends thereof. Such bristles are in proximity to the apertures of the upper plate just beneath the surface thereof. In the preferred embodiment, such brush bristles include the first set of parallel rods having short cone-shaped bristles 44 to clean a nipple. The second and third sets of parallel rods have short cylindrical bristles 46 and 48 to clean a lid and a cap respectively. The fourth set of parallel rods has long cylindrical bristles 50 to clean a bottle. With the center rod of each set of rods cleaning the interior of an object, the adjacent bristles clean the outside of such object.

Also located within the housing is a motor 54. The motor is within the housing and geared to the main drive shaft to effect the activation and inactivation of the main drive shaft as well as the associated gears and parallel shafts. In this manner, when a baby bottle, cap, lid and nipple are positioned through the apertures onto the bristles beneath the apertures, they are positioned onto the central bristles of each set whereby the objects inserted in the aperture will be cleaned inside and out when the motor is activated.

To preclude unwanted splashing, a lid 58 is positioned over the upper plate of the housing. It is adjacent to the apertures around the periphery of the upper edge of the housing to seal the interior of the housing during operation and use. Hinges 60 are located adjacent one upper edge of the housing and an adjacent edge of the lid to effect the opening and closing of the lid to allow the convenient loading and unloading of objects as well as their cleaning.

Figure 2:
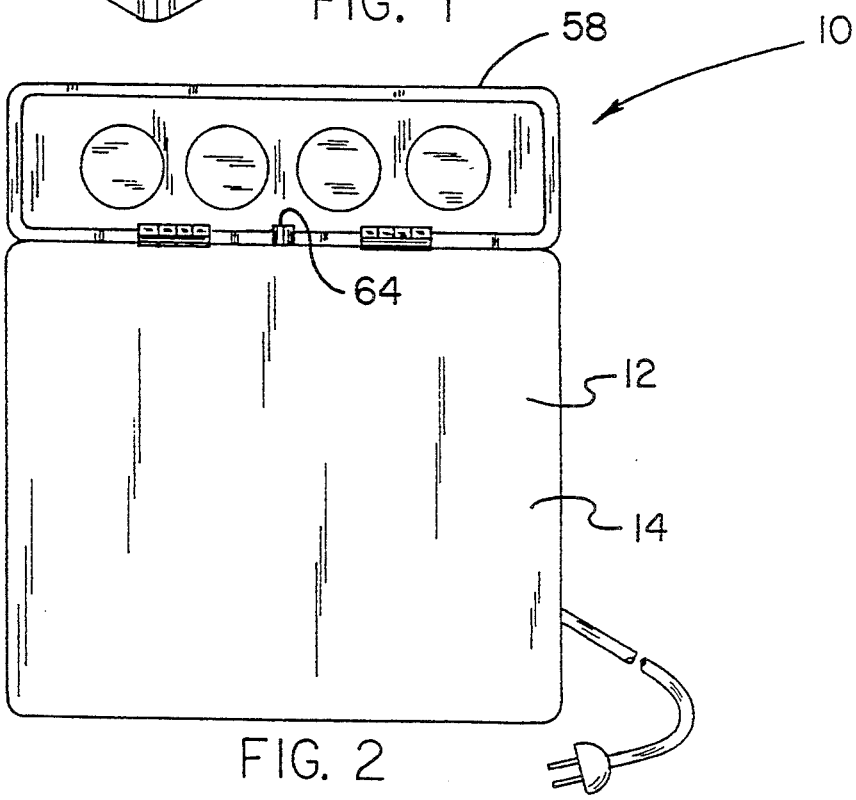
FIG. 2 is a front elevational view of the device shown in FIG. 1.
Figure 3:
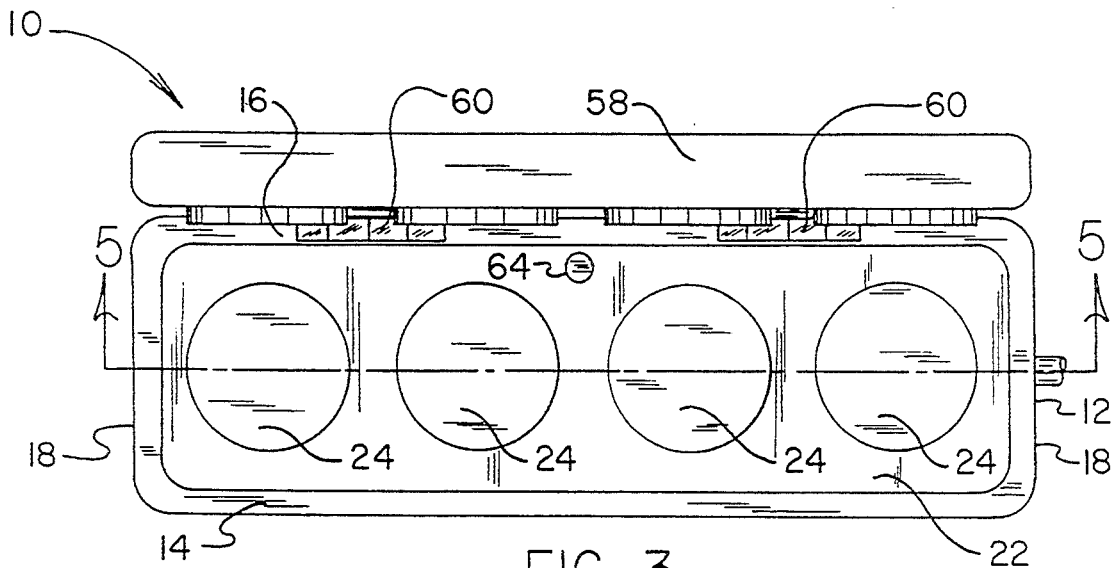
FIG. 3 is a top elevational view of the device shown in FIGS. 1 and 2.
Figure 4:
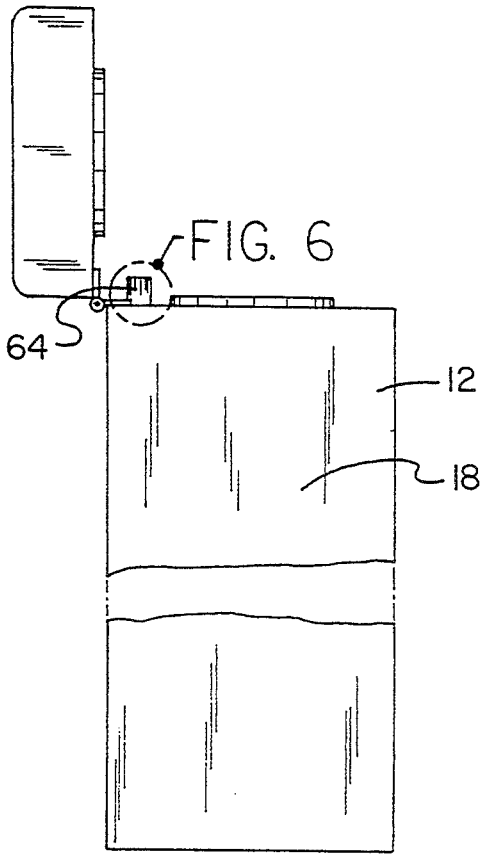
FIG. 4 is a side elevational view of the device as shown in the prior Figure.
Figures 5, 7, 8:
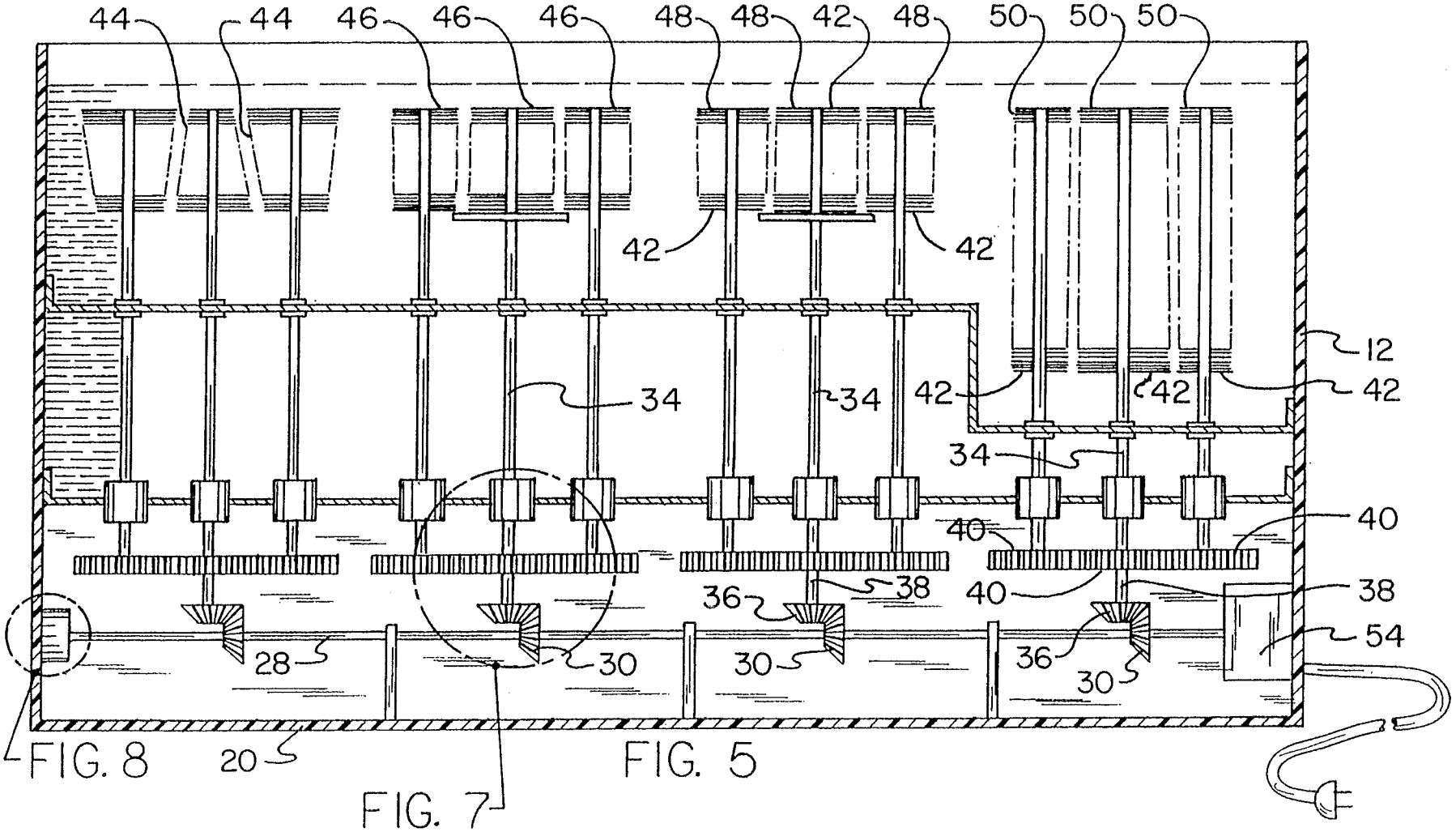
FIG. 5 is a cross-sectional view taken along lines 5—5 of FIG. 3.
FIG. 7 is an enlarged elevational view of the gear components taken along circle 7 of FIG. 5.
FIG. 8 is an enlarged elevational view of the bearing support members taken about circle 8 of FIG. 5.
Figure 6:
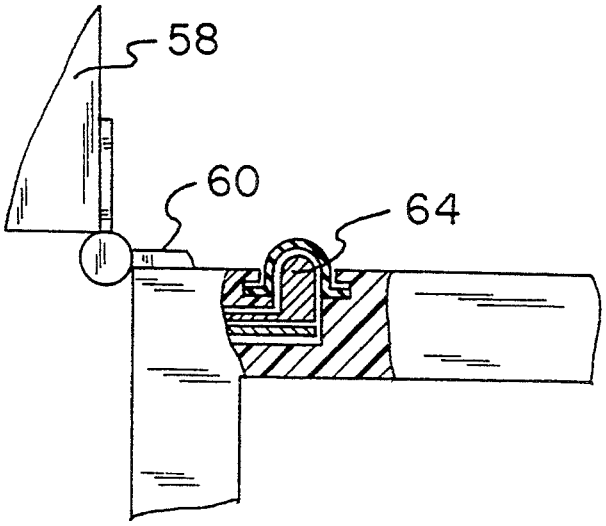
FIG. 6 is an enlarged side elevational view of the control button taken about the circle of FIG. 6.
Figure 7:
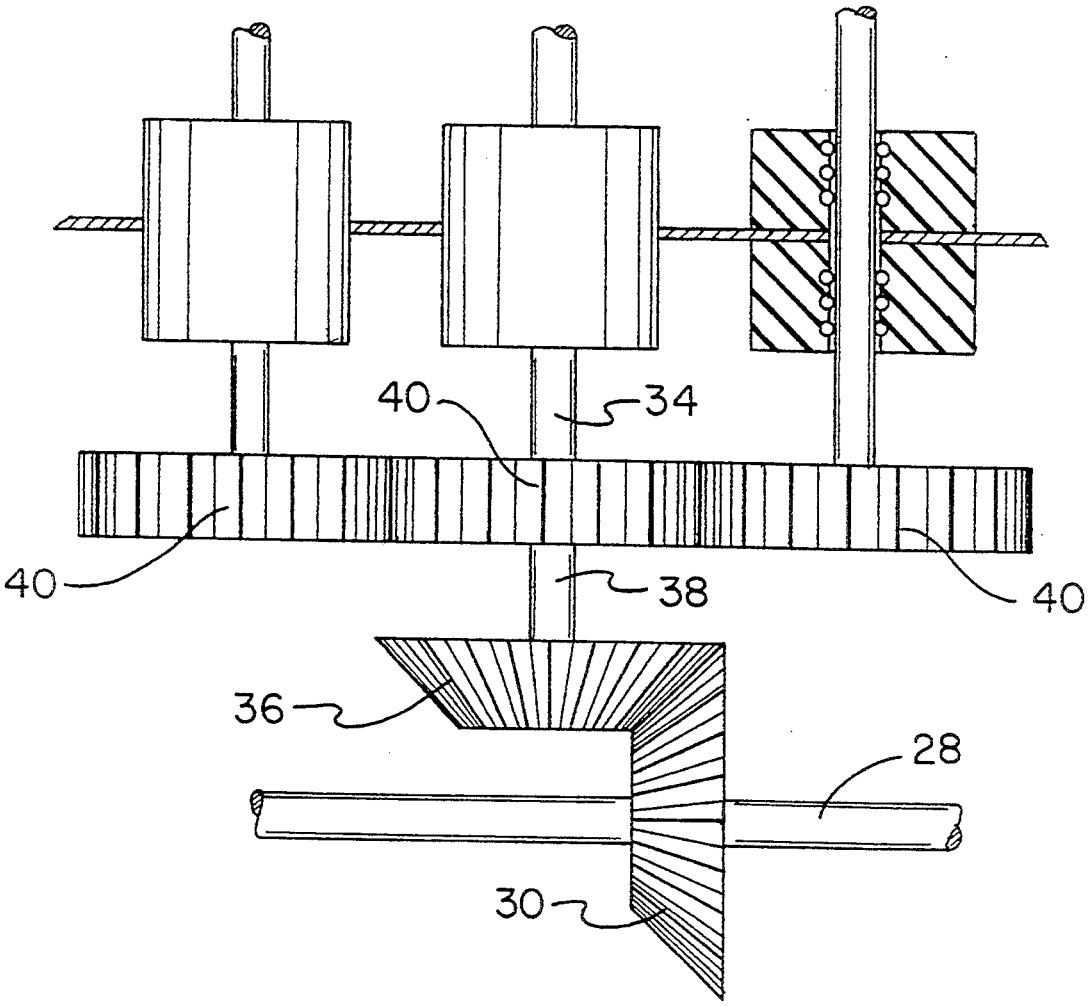
Figure 8:
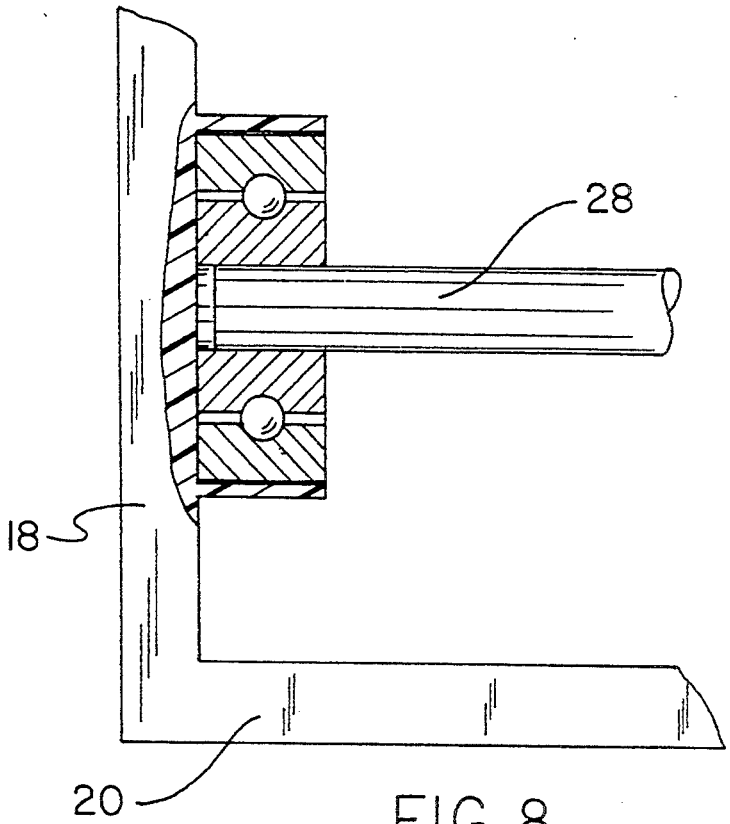
Figure 9:
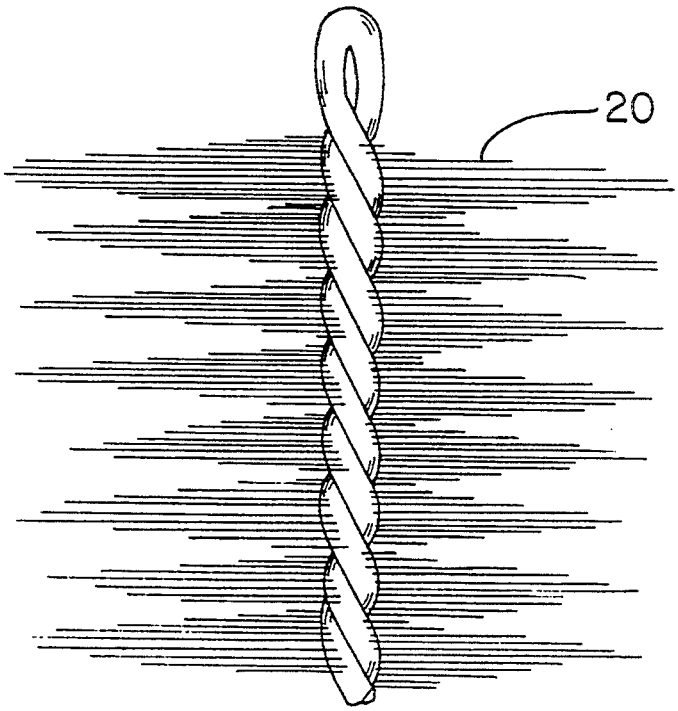
FIG. 9 is an enlarged illustration of one of the bristle structures.

The last component of the system is an actuation button 64. Such button is secured to the housing adjacent to the lid. As can be seen in FIGS. 1, 2 and 6, when the lid is closed, the button will be depressed to activate the motor. This effects the rotation of all the bristles for the cleaning of objects within the housing.

The present invention is an electric-powered washing machine for baby bottles and their associated parts. It is enclosed in a rectangular housing with a lid on its top. It consists of a motor and gear compartment in its lower section and a washer compartment in its upper section.

An electric motor with a horizontal shaft which extends the length of the cabinet is mounted on the inside edge of the lower compartment. Four 45-degree bevel gears are mounted on the shafts and are located at equidistance positions from each other. Four additional 45-degree bevel gears mesh with the above gears and are mounted on the lower end of four vertical shafts. These shafts extend through holes in the wall which separates the compartments to just below the top of the cleaning compartment. The vertical shafts in the cleaning compartment are mounted parallel to other shafts that are connected to them by meshing circular gears so that they turn when the bevel gear turns. The shaft in the center turns clockwise and the two outside turn counterclockwise.

Watertight seals are installed around each shaft where they extend through the wall between the two compartments. Brushes of varying designs accommodate the cleaning of the bottle, nipple, lid or cap and are secured to the tops of the shafts. One set of three brushes cleans the bottle, one cleans the nipple, on the lid, and one the cap. An on/off button is located under the lid which is activated when the lid is closed and deactivated when it is opened.

To wash the bottle, nipple, lid and cap simultaneously, one simply places them over the appropriate center brush, fills the cleaning compartment with a dishwasher detergent, closes the lid and lets the present invention perform its task. The center brush cleans the inside of each part while the two outer brushes clean the outside of each part.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for washing a plurality of baby bottles and associated components concurrently comprising, in combination:

a housing having large rectangular front and rear walls, small rectangular side walls, a lower base coupling together the walls in a box-like configuration and an upper plate with a plurality of aligned apertures extending therethrough;

a main drive shaft mounted for rotation adjacent to the lower surface of the housing parallel with the base, the main drive shaft having a plurality of driving bevel gears spaced along its length;

a plurality of driven shafts with driven bevel gears in operative association with the driving bevel gears of the main drive shaft, each driven bevel gear having in association therewith three parallel rods with mating gears interrelated with its associated driven bevel gear to effect rotation of the mating gears and parallel rods from the driven bevel gears;

brush bristles formed at the upper ends of the parallel rods in proximity to the apertures of the upper plate the first set of parallel rods having short cone-shaped bristles to clean a nipple, the second and third set of parallel rods having short cylindrical bristles to clean a lid and a cap, the fourth set of parallel rods having long cylindrical bristles to clean a bottle, inside and outside;

a motor within the housing geared to the main drive shaft to effect the activation and inactivation of the drive shaft and associated gears and parallel shafts whereby when a baby bottle, cap and nipple are positioned through the apertures onto the bristles, they will be cleaned inside and outside when the motor is activated;

a lid positionable over the upper plate of the housing adjacent to the apertures to seal the interior of the housing during operation and use with hinges along adjacent edges of the housing and lid to effect the opening and closing thereof; and an actuation button secured to the housing adjacent to the lid whereby when the lid is closed the button will be depressed to activate the motor to effect the cleaning of objects within the housing.

2. An apparatus for washing a plurality of baby bottles and associated components concurrently comprising:

a housing having large rectangular front and rear walls, small rectangular side walls, a lower base coupling together the walls in a box-like configuration and an upper plate with a plurality of aligned apertures extending therethrough;

a main drive shaft mounted for rotation adjacent to the lower surface of the housing parallel with the base, the main drive shaft having a plurality of driving bevel gears spaced along its length;

a plurality of driven shafts with driven bevel gears in operative association with the driving bevel gears of the main drive shaft, each driven bevel gear having in association therewith a plurality of parallel rods with mating gears interrelated with its associated driven bevel gear to effect rotation of the mating gears and parallel rods from the driven bevel gears;

brush bristles formed at the upper ends of the parallel rods in proximity to the apertures of the upper plate;

a motor within the housing geared to the main drive shaft to effect the activation and inactivation of the drive shaft and associated gears and parallel shafts whereby when a baby bottle, cap and nipple are positioned through the apertures onto the bristles, they will be cleaned inside and outside when the motor is activated; and a lid positionable over the upper plate of the housing adjacent to the apertures to seal the interior of the housing during operation and use with hinges along adjacent edges of the housing and lid to effect the opening and closing thereof.

3. The apparatus as set forth in claim 2 and further including:

an actuation button secured to the housing adjacent to the lid whereby when the lid is closed the button will be depressed to activate the motor to effect the cleaning of objects within the housing.

* * * * *